US006267262B1

(12) United States Patent
Wilner

(10) Patent No.: US 6,267,262 B1
(45) Date of Patent: Jul. 31, 2001

(54) GAME TICKET DISPENSER AND DISPENSING METHOD

(76) Inventor: Joseph Wilner, 8440 Pflumm Cir., Lenexa, KS (US) 66215

( * ) Notice: Subject to any disclaimer, the term of this patent is extended or adjusted under 35 U.S.C. 154(b) by 0 days.

(21) Appl. No.: 09/301,660

(22) Filed: Apr. 28, 1999

(51) Int. Cl.[7] ..... A47R 10/24
(52) U.S. Cl. ..... 221/45; 221/63
(58) Field of Search ..... 221/33, 45, 46, 221/48, 63, 303, 307, 310; 206/812, 494

(56) References Cited

U.S. PATENT DOCUMENTS 3,083,866 * 4/1963 Strange ..... 221/63
3,258,156 * 6/1966 Smith ..... 221/63
3,369,699 * 2/1968 Enloe et al. ..... 221/48
4,200,200 * 4/1980 Hein, III et al. ..... 221/48
5,024,349 * 6/1991 Haenni ..... 221/63

* cited by examiner

*Primary Examiner*—Kenneth W. Noland

(57) ABSTRACT

A dispenser for game tickets for playing games of chance includes top, bottom, front, back and opposite end panels. The panels are folded and secured to each other to form a dispenser box. A cutout in the top panel is adapted for removal by separating the top panel along a perforated tear line to form a discharge opening. Game ticket assemblies comprising one or more folded and secured game tickets are placed in the box for dispensing through the discharge opening. A game ticket dispensing method includes the steps of providing a box with a top panel having perforated tear line, loading ticket assemblies each comprising one or more tickets in the box, removing the cutout from the top panel to form a discharge opening, and dispensing ticket assemblies through the discharge opening.

8 Claims, 5 Drawing Sheets

GAME TICKET DISPENSER AND DISPENSING METHOD

Background of the Invention

1. Field of the Invention

The present invention relates generally to gaming, and more particularly to a device and method for dispensing game tickets for playing games of chance for monetary prizes.

2. Description of the Prior Art

Gaming is a widely popular form of entertainment and an economically important industry. State-run lotteries and other games of chance produce significant amounts of revenue for funding various socially beneficial activities such as education, economic development, etc.

In the private sector, games of chance are often used for both fundraising and entertainment purposes. For example, various charitable, social and fraternal organizations purchase sets of game materials consisting of game cards and tickets. Game cards typically have break-open windows or scratch-off areas for concealing winning and losing symbols prior to purchase. Game tickets are typically folded and sealed for concealing winning and losing symbols prior to purchase. Players unfold them to reveal the symbols as the games are played. Winning game symbols typically entitle the players to monetary prize amounts. The games can be designed with predetermined payout percentages. The game operators are thus assured of predetermined profit amounts after all of the cards or tickets are sold and all of the prizes are awarded.

The prior art includes various devices for packaging, promoting, displaying, and dispensing game cards and tickets. For example, folded-and-sealed tickets have for many years been placed in transparent glass and plastic jars, thus acquiring the designation "jar ticket". However, jars are not well suited for packaging with modern, high-speed packaging equipment. Moreover, jars can be impractical to ship due to their size, shape, weight, and susceptibility to breakage. Cardboard boxes are therefore preferred for packaging and shipping game cards and tickets. However, a disadvantage with many of the cardboard boxes currently used for packaging and shipping game cards and tickets is that they are not particularly convenient for dispensing tickets. Game operators must therefore transfer the cards and tickets to other containers, such as jars, for display and sale. Although this distribution system is in widespread use, the labor and inconvenience associated with handling and transferring large volumes of cards and tickets are significant disadvantages.

The present invention addresses the disadvantages of previous devices and methods of packaging, shipping, displaying, and distributing cards and tickets for playing games of chance. Heretofore there has not been available a game ticket dispenser and dispensing method with the advantages and features of the present invention.

SUMMARY OF THE INVENTION

In the practice of the present invention, a game ticket dispenser has the general configuration of a box with a removable cutout through which the box contents can be removed. The contents can comprise a set of folded-and-sealed game ticket assemblies each having one or more individual tickets with indicia printed thereon for determining the winning or losing status of a particular ticket. In the practice of the method of the present invention, customer orders for game ticket sets are processed by a method including the steps of producing sets of game tickets and loading the game tickets into boxes. The boxes are formed with cutouts in their top panels. The cutouts are removed by the game operators at points of purchase and the game tickets can be extracted therethrough for sale and distribution to the players.

OBJECTS AND ADVANTAGES OF THE INVENTION

The principal objects and advantages of the present invention include: providing a game ticket dispenser and dispensing method; providing such a dispenser and method which can reduce ticket handling; providing such a dispenser and method which facilitate packaging and shipment; providing such a dispenser and method which can utilize existing game ticket packaging equipment; providing such a dispenser and method which enhance the display of the game materials at a point of purchase; providing such a dispenser and method which can be made and practiced with existing equipment with little or no modification; providing such a dispenser and method which provide security for the game materials; providing such a dispenser and method which can promote sales of game tickets; and providing such a dispenser and method which are economical, efficient, and particularly well-adapted for dispensing game tickets for playing games of chance.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction

Figures 1, 1A:
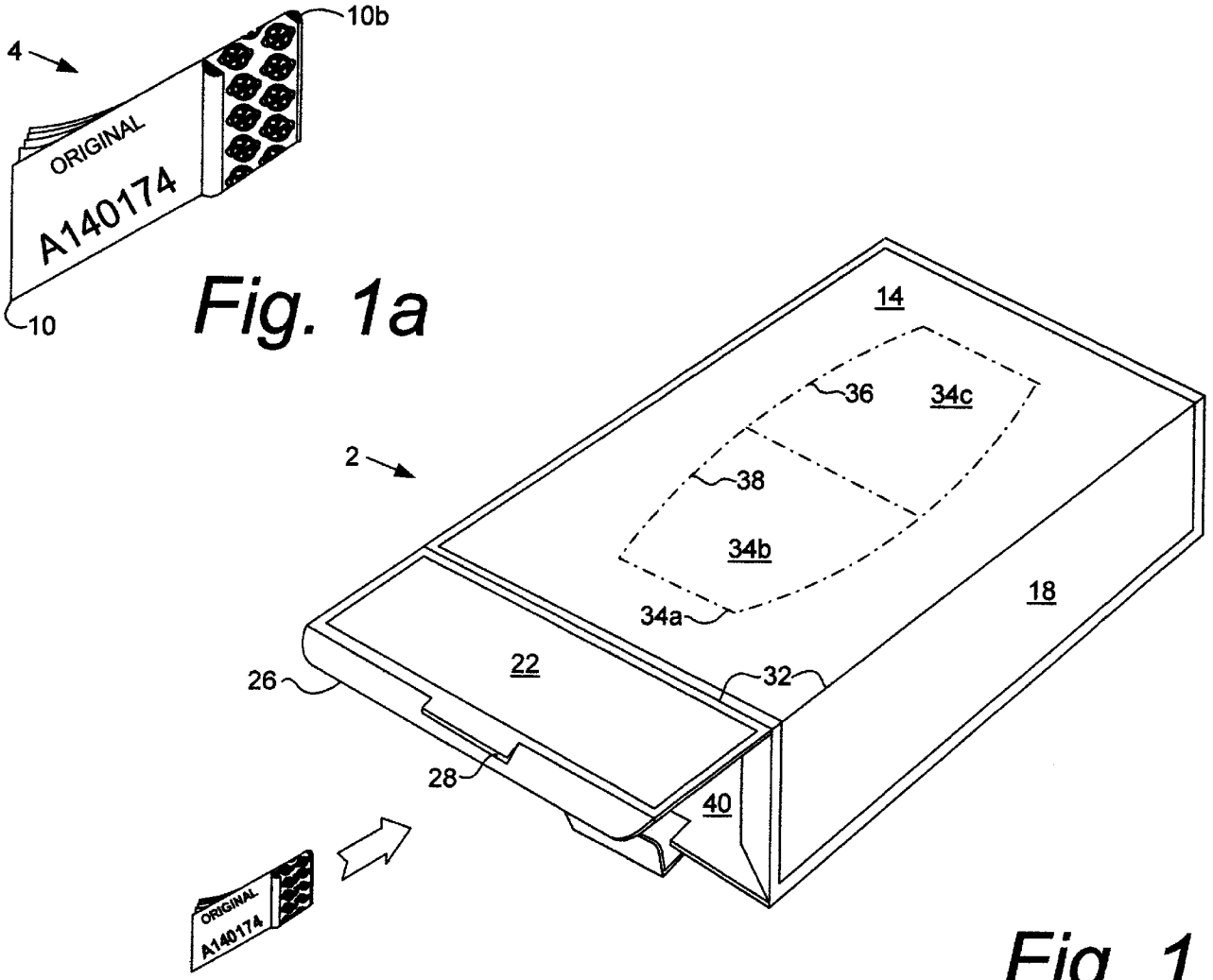
FIG. 1 is an upper, perspective view of a game ticket dispenser embodying the present invention, shown with an open end for loading game ticket assemblies into the dispenser.
FIG. 1*a* is an enlarged, perspective view of a game ticket assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Game Ticket Dispenser 2

Referring to the drawings in more detail, the reference number 2 generally designates a dispenser or box for dispensing and/or displaying game materials for playing games of chance. The game materials include game ticket bundles or assemblies 4 each comprising one or more individual game tickets 10. Such game tickets are well known in the art. Each game ticket 10 includes a game symbol end 10*a* with a concealed game symbol printed thereon. The game symbol end 10*a* of the ticket 10 is folded over on itself one or more times (e.g., a double fold forming a triple thickness is common) whereby the game symbol is concealed when the ticket 10 is folded and is exposed when the ticket 10 is unfolded. Each game ticket bundle or assembly 4 includes a band 16 for securing the game ticket(s) in a folded configuration (FIG. 1) with the game symbol(s) concealed. The construction and operation of the game ticket bundles or assemblies 4 and the individual game tickets 10 are described in greater detail in the commonly-assigned, co-pending Wilner U.S. patent application Ser. No. 08/923, 448, filed Sep. 4, 1997, for GAME TICKET ASSEMBLY WITH PRINTED BAND, now Wilner U.S. Pat. No. 5,921, 547 which is incorporated herein by reference.

Multiple game ticket assemblies 4 comprise a game material set 18. Ticket counts ranging from a few hundred to several thousand are typical. Each game material set 18 also includes a box dispenser 2, and can also include promotional materials such as printed promotional sheets, etc. At points of purchase players normally purchase the game ticket assemblies 4 singly or in groups. Instant prizes can be awarded based on the concealed game symbols. Optional bonus prizes can be awarded after all of the tickets 10 in a game set 18 have been sold. Selling all of the tickets 10 and awarding all of the prizes concludes the game.

Figure 3:
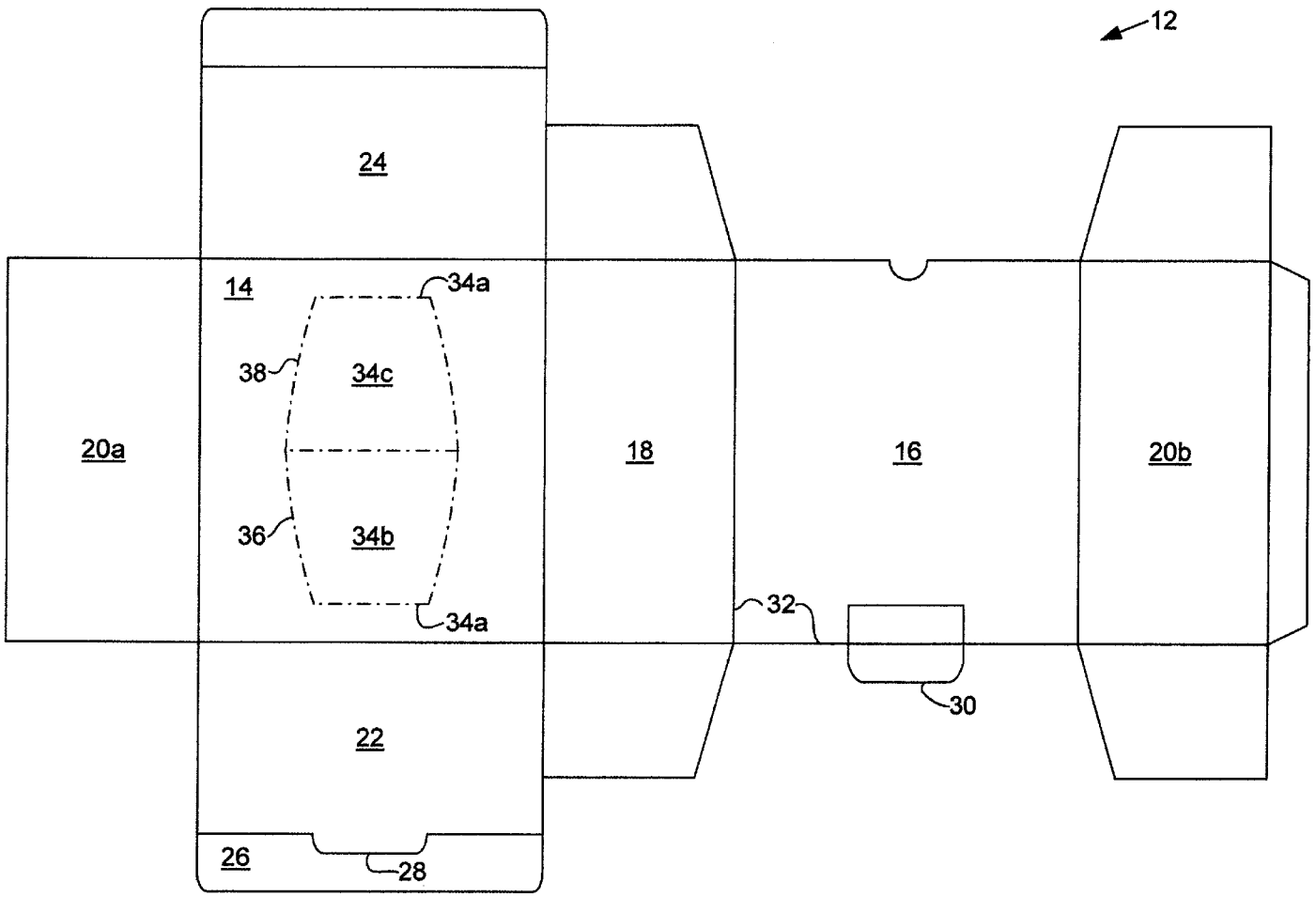
FIG. 3 is a plan view of a cardboard blank for the dispenser.

The box 2 can be constructed in any suitable manner. For example, a cardboard blank 12 is shown in FIG. 3 and can be die cut from suitable cardboard stock. The blank 12 includes top and bottom panels 14, 16; a front panel 18; a back panel 20 comprising outer and inner layers 20*a,b;* and opposite first and second end panels 22, 24.

Figure 2:
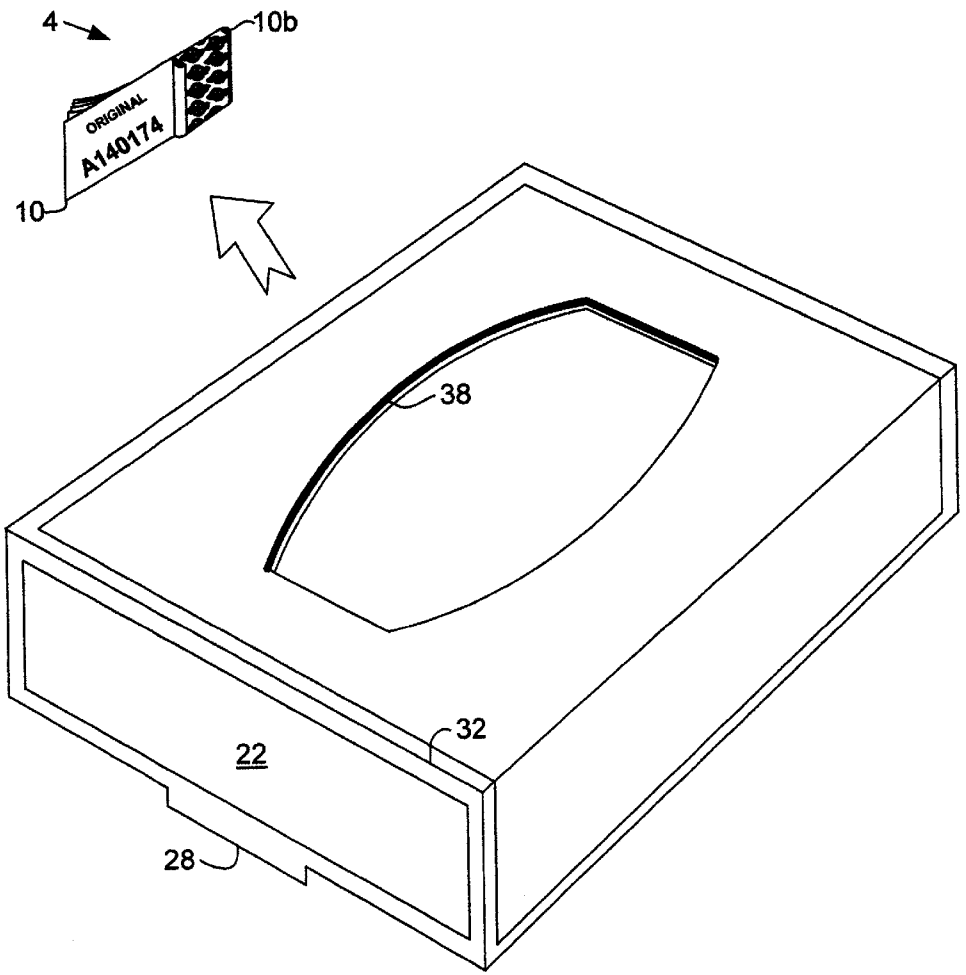
FIG. 2 is an upper, perspective view of the dispenser, shown with a cutout removed from a top panel of the dispenser for dispensing the ticket assemblies therefrom.

The first end flap 22 includes an extension 26 and further includes a slot 28 located adjacent to the extension 26. The bottom panel 16 includes a folding tongue which is removably receivable in the slot 28 with the first end panel 22 closed (FIG. 2). Extracting the tongue 30 from the slot 28 permits the first end panel 22 to be opened (FIG. 1). The panels 14–24 of the box blank 12, and the various flaps and other parts thereof, are separated by score lines 32 which facilitate folding the blank 12 to its final, assembled configuration (FIG. 2). The assembled box 2 has an interior 40 which is accessible through the cutout opening 38 and through an end of the box 2 with the first end panel 22 open (FIG. 1).

The top panel 14 includes a cutout 34 with the general configuration of an oval with truncated ends 34*a*. The cutout is formed by a perforated tear line 36 to facilitate its removal from the remainder of the top panel 14, thus leaving a cutout opening 38. A medial tear line 37 extends across the cutout 34 for optionally removing it in halves 34*b,c*.

Promotional printing 42*a,b* is applied to the top and front panels 14, 18 and to the end panels 22, 24 respectively by either printing directly on the blank 12 or by printing on labels which are then adhesively mounted on the blank 12. The printing 42*a,b* can include text and graphics for attracting attention and for conveying information.

III. First Modified Embodiment Game Ticket Dispenser 102

Figure 4:
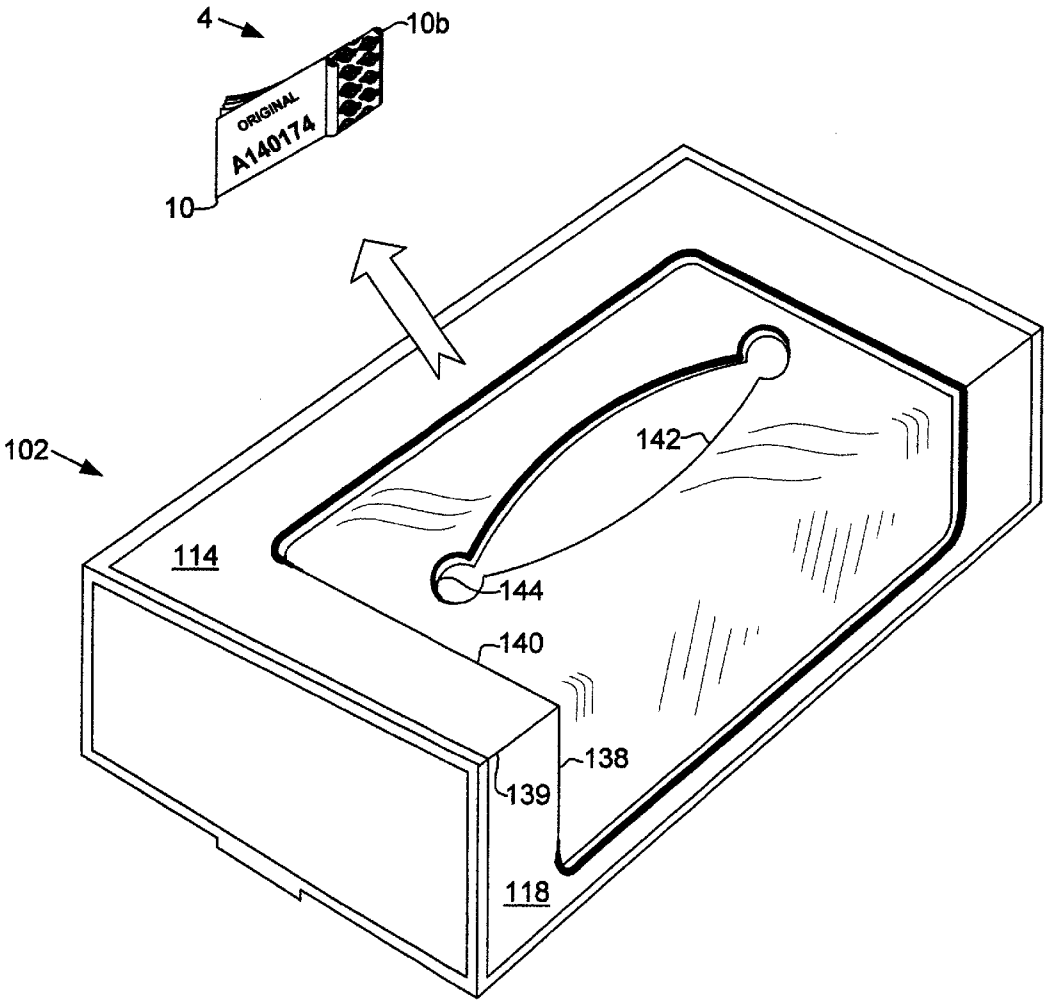
FIG. 4 is an upper, perspective view of a dispenser comprising a first modified embodiment of the present invention with a transparent, plastic view window for viewing the dispenser contents.

A game ticket dispenser or box 102 comprising a first modified embodiment of the present invention is shown in FIG. 4. The dispenser or box 102 includes top and front panels 114, 118, which include a cutout opening 138. The cutout opening 138 wraps across an upper, front edge 139 of the box 102 to provide maximum visibility of the contents of the box 102 when viewed from the front and above.

A transparent, flexible, plastic window 140 is mounted on the inside faces of the top and front panels 114, 118 to cover the cutout opening 138. The window 140 includes a transversely-extending slit 142 with circular slit ends 144 which facilitate opening and closing the slit 142. The slit 142 is preferably sized to allow a person to reach inside the dispenser or box 102 and extract one or more of the game ticket assemblies 4. The modified embodiment dispenser or box 102 accommodates both high visibility for the ticket assembly contents and convenient operation in extracting the ticket assemblies 4. Moreover, the cooperation of the slit 142 with the flexible plastic window 140 helps to retain the ticket assemblies 4 within the box 102, thus reducing the risk of accidental dispensing and loss.

IV. Ticket Dispensing Method

Figure 5:
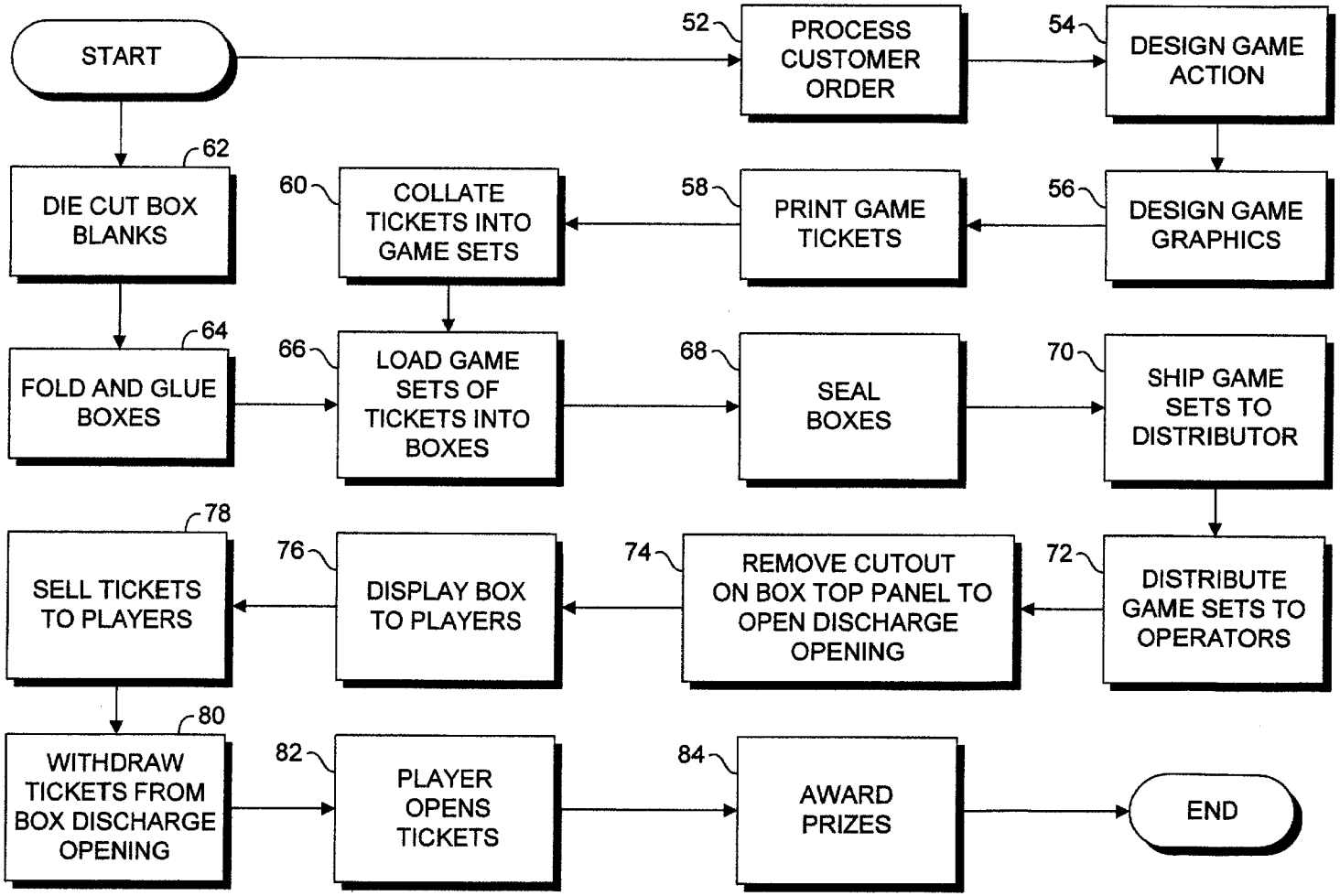
FIG. 5 is a flowchart showing the dispensing method of the present invention.

FIG. 5 is a flowchart showing a method of dispensing ticket assemblies 2 embodying the present invention. A customer order is processed, a game action is designed, and game graphics are designed at steps 52, 54, 56 respectively. The game tickets 10 are printed at step 58 and are collated into game material sets 6 at step 60. While the aforementioned steps are occurring, the box blanks 12 can be cut and the boxes 2 are folded and glued at steps 62, 64 respectively. The game sets 6 of ticket assemblies 4 are loaded into the boxes 2 at step 66 and the boxes 2 are sealed at step 68. The game material sets 6 are shipped to distributors at step 70 for distribution to operators at step 72.

At a point of purchase, the operator can prepare the dispenser or box 2 for operation by removing the cutout 34 along its perforated tear lines 36 at step 74. The box 2 is displayed to players and tickets 10 are sold at steps 76, 78. The sold tickets 10 are withdrawn from the box discharge opening 38 at step 80. The players open their tickets 10 at step 82 and are awarded prizes at step 84 to conclude the game.

It is to be understood that while certain forms of the present invention have been illustrated and described herein, it is not to be limited to the specific forms or arrangement of parts described and shown.

What is claimed and desired to be secured by Letters Patent is as follows:

1. A dispenser for game tickets for playing games of chance, which comprises:

a) a top panel;

b) a bottom panel;

c) a front panel;

d) a back panel;

e) a pair of opposite end panels;

f) said panels being connected together to form a box with an interior;

g) said top panel having a removable cutout formed by a perforated tear line in said top panel, said cutout being selectively removable from said top panel by separating said top panel along said perforated tear line;

h) one of said end panels having a transversely-extending score line, a transversely-extending slot, and an extension distally from said score line and from said slot; and i) said bottom panel having a tongue removably received in said one end panel slot for retaining said one end panel in a closed position thereof.

2. The dispenser according to claim 1 wherein said cutout has a generally oval configuration with truncated ends.

3. The dispenser according to claim 1, which includes:

a) said cutout having a medial perforated tear line extending there across from front-to-back.

4. The dispenser according claim 1, which includes promotional printing on at least one of said top, front, and end panels.

5. A dispenser for game tickets for playing games of chance, which comprises:

a) a top panel;

b) a bottom panel;

c) a front panel;

d) a back panel;

e) a pair of opposite end panels;

f) said panels being connected together to form a box with an interior;

g) said top panel having a removable cutout formed by a perforated tear line in said top panel, said cutout being selectively removable from said top panel by separating said top panel along said perforated tear line;

h) an upper, front edge formed by a score line between said top panel and said front panel;

i) said removable cutout and said perforated tear line extending across a portion of said top panel and a portion of said front panel; and j) a cutout opening formed in said top and front panels when said cutout is removed therefrom, said cutout opening extending across said upper, front edge.

6. The dispenser according to claim 5, which includes:

a) a transparent, flexible, plastic window mounted on inside faces of said top and front panels in covering relation with respect to said cutout opening, said window having a longitudinally-extending slit with opposite ends.

7. The dispenser according to claim 6, which includes:

a) a pair of circular openings in said window each located at and in communication with a respective end of said slit.

8. In combination with a plurality of game ticket assemblies each comprising at least one ticket at its end to conceal a game symbol, the improvement of a dispenser, which comprises:

a) a top panel;

b) a bottom panel;

c) a front panel;

d) a back panel, e) a pair of opposite end panels;

f) said panels being connected together to form a box with an interior;

g) said top panel having a removable cutout formed by a perforated tear line in said top panel, said cutout being selectively removable from said top panel by separating said top panel along said perforated tear line; and h) one of said end panels having open and closed positions for selectively providing access to said box interior whereby said game ticket assemblies can be placed therein with said one end panel in its open position and secured therein with said one end panel in its closed position.

* * * * *